United States Patent [19]

Kai et al.

[11] 4,195,464

[45] Apr. 1, 1980

[54] VACUUM-SUCTION TYPED HOLDER FOR FLEXIBLE, TUBE-SHAPED FILM MATERIALS

[75] Inventors: Hisao Kai, Chiba; Tomohiko Yoshimatsu, Tokyo, both of Japan

[73] Assignee: Asahi-Dow Limited, Tokyo, Japan

[21] Appl. No.: 932,365

[22] Filed: Aug. 9, 1978

Related U.S. Application Data

[62] Division of Ser. No. 826,835, Aug. 22, 1977.

[51] Int. Cl.[2] ..... B65B 43/34

[52] U.S. Cl. ..... 53/386; 269/21

[58] Field of Search ..... 53/386; 279/3; 269/21

[56] References Cited

U.S. PATENT DOCUMENTS

| | | | |
|---|---|---|---|
| 2,281,516 | 4/1942 | Royal | 53/386 |
| 2,418,142 | 4/1947 | Socke | 53/386 |
| 3,298,156 | 1/1967 | Lerner | 53/386 X |

FOREIGN PATENT DOCUMENTS

| | | | |
|---|---|---|---|
| 650163 | 2/1951 | United Kingdom | 53/386 |

*Primary Examiner*—Travis S. McGehee

*Attorney, Agent, or Firm*—Frishauf, Holtz, Goodman & Woodward

[57] ABSTRACT

A vacuum-suction typed holder for flexible tube-shaped film materials made from plastics wherein the tube-shaped film materials whose upper end open and the bottom is sealed are fed thereinto and they are rendered to expand by suction applied from the periphery thereof, in order to facilitate to put, for example, sausage therein.

3 Claims, 4 Drawing Figures

VACUUM SUCTION TYPED HOLDER FOR FLEXIBLE, TUBE-SHAPED FILM MATERIALS

This is a division, of application Ser. No. 826,835, filed Aug. 22, 1977.

BACKGROUND OF THE INVENTION

The present invention relates to a holder for flexible tube-shaped packaging materials. Particularly, the present invention concerns a vacuum-suction typed holder for holding flexible tube-shaped film materials in their expanded condition.

There are well known flexible tube-shaped films for packaging various foodstuffs. It is required that the tubes are held in their expanded condition when the foodstuff is packed thereinto. In the past, the expanding of the tubes was manually effected in a packing station.

It is an object of the present invention to provide a novel holder of such a type that flexible tube-shaped film materials are held in their expanded condition under the influence of vacuum. The holder may be effectively used in any automatically packaging machine in which the flexible tube-shaped film materials can be packed with any materials such as foodstuffs.

SUMMARY OF THE INVENTION

The present invention provides a vacuum-suction typed holder for holding a flexible tube-shaped film material in its expanded condition, comprising a double-walled tube member having a cylindrical outer wall and a cylindrical inner perforated wall spaced inward from said outer wall, said outer and inner walls defining an annular chamber which is closed at its opposite ends by end sealing members and adapted to be connected to a source of vacuum, the inner periphery of said inner perforated wall being adapted to receive and holding said flexible tube-shaped film material in its expanded condition by applying vacuum thereto from said source of vacuum through said annular chamber.

DETAILED DESCRIPTION

Figure 1:
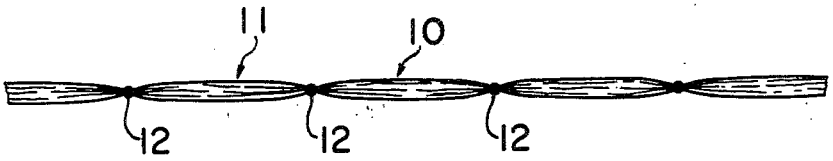
FIG. 1 is a schematic side view showing a continuous length of flexible tube-shaped film according to the present invention.
Figure 2:
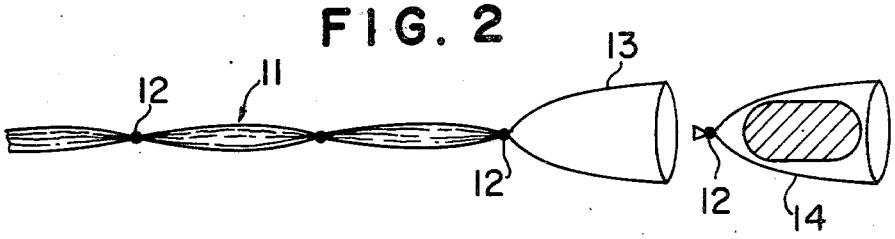
FIG. 2 illustrates a packing operation carried out according to the present invention by using such packaging material as shown in FIG. 1.
Figure 3:
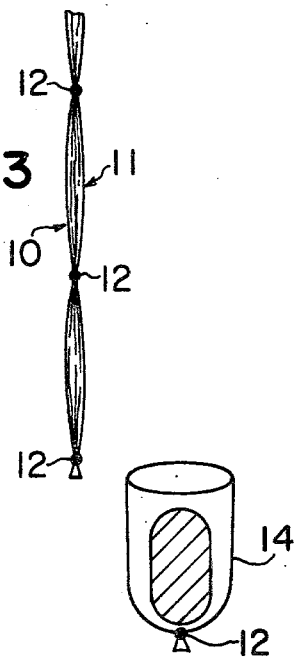
FIG. 3 illustrates another packing operation effected according to the present invention by using the packaging material as shown in FIG. 1.

Referring to FIG. 1, a packaging material 10 which is suitable for using in a holder according to the present invention comprises a continuous length of tube 11 which is made of flexible film or laminated film formed from any heat-shrinkable synthetic resin having oxygen and water vapor barrier properties. Such synthetic resins include polyvinyl chloride, vinylidene chloride-vinyl chloride copolymer, ionomer, polypropylene, polyethylene, polyester, polyamide polymer, polyvinyl alcohol, ethylene-vinyl acetate copolymer resin, irradiated polyethylene and the like. It is preferred to use films formed from vinylidene-chloride-vinyl achloride copolymer or polyamide polymer. It is further preferred to use vinylidene-chloride-vinyl chloride copolymer films in that they are higher in all of its heat-shrinkability and oxygen and water vapor barrier properties. Aluminum foil may be used as a layer in the tube-shaped film.

If the flexible laminated film is used to form the tube 11, it may include one of the following laminated structures; polyamide polymer/polyethylene, polyamide polymer/ethylene-vinyl acetate copolymer resin, vinylidene chloride-vinyl chloride copolymer/ethylene-vinyl acetate copolymer resin, polyethylene/polyamide polymer/polyethylene, polyethylene/vinylidene chloride-vinyl chloride copolymer/polyethylene, polyethylene/vinylidene chloride-vinyl chloride copolymer-/ethylene-vinyl acetate copolymer resin, polyethylene/polyamide polymer/ethylene-vinyl acetate copolymer resin, polyethylene/aluminum foil/polyethylene, polypropylene/aluminum foil/polypropylene, vinylidene chloride-vinyl chloride copolymer/irradiated polyethylene, polyamide polymer/vinylidene chloride-vinyl chloride copolymer/polyethylene, polyester/-polypropylene, polyester/polyethylene, polyethylene/-polyester/polyethylene, polypropylene/polyester/-polypropylene, polyester/aluminum foil/polyethylene and polyester/aluminum foil/polypropylene. The laminated structure is preferably polyamide polymer/-polyethylene, polyamide polymer/ethylene-vinyl acetate copolymer resin or vinylidene chloride-vinyl chloride copolymer/ethylene-vinyl acetate copolymer resin.

The oxygen barrier property may be indicated by oxygen permeability. Preferable value is 1200 cc/mil/$m^2$/24 hrs/1 atm or less measured by ASTM-D-1434 at 23° C. under 0% RH (relative humidity) in the present invention. The water vapor barrier property may be indicated by water vapor permeability which is preferred to be 50 gram/$m^2$/24 hrs or less measured by ASTM-E-96 at 37° C. under 90% RH in the present invention.

The tube 11 has flat width of 50 mm to 600 mm, interval between ligations described hereinafter of 150 mm to 1000 mm, and film thickness of 15 $\mu$ to 100 $\mu$.

Referring again to FIG. 1, the tube 11 is ligated airtightly at regular intervals in a collapsed form by any suitable means such as aluminum wire, cotton yarn or the like to form a plurality of ligations 12 disposed at equalized distance along the length of the tube 11. Therefore, the tube 11 s substantially no air therewithin. However, the tube 11 may contain any amount of air in that tube portion between the ligations 12 unless the feeding and packing operations as described hereinafter are adversely affected by the contained air.

The tube 11 may be wound into a roll (not shown) or folded over in any suitable supply box (not shown). The rolled or folded over tube 11 is fed intermittently to any packing station as well known in the art. The fed tube 11 includes its tube portion 13 having opened end which results from severing the tube 11 at a position immediately behind the ligation 12 of the proceeding tube portion to form a tube element 14.

The open-ended tube portion 13 which reaches the packing station is widened at the open end thereof and firmly held in any suitable manner. For example, this tube portion 13 may be fed into a cylindrical chamber having inner periphery through which vacuum is applied to the outer periphery of the tube portion 13 disposed therein. Furthermore, the tube portion 13 may be opened by blowing air through any suitable pipe means prior to holding under vacuum.

The widened tube portion 13 is then packed with any object such as crude meat through the widened end thereof and thereafter severed at a position of the tube 11 immediately behind the ligation 12 on the closed end of the packed tube portion 13 to form a packed tube element 14. The opened end of the packed tube element 14 is then sealingly ligated by an aluminum wire as shown by 12A in FIG. 4 and removed from the packing station as by releasing the action of vacuum. After removing, the sealed tube element 14 may be subjected to any subsequential procedure such as heat-shrinking, surface sterilization or the like, resulting in a package 15 as shown in FIG. 4.

Although the tube has been described as fed horizontally to the packing station, it may be fed vertically to a packing station in which liquid rather than solid foodstuffs may be packed into the tube element 14. In this case, the tube 11 is severed at a position immediately before the ligation 12 of that tube portion 13 following the leading tube portion to be cut off. The tube element 14 cut off is held by any suitable means such as vacuum with widened end thereof oriented upward. Under such a state, similarly, the tube element 14 is packed with any object such as solid or liquid foodstuffs.

Figure 4:
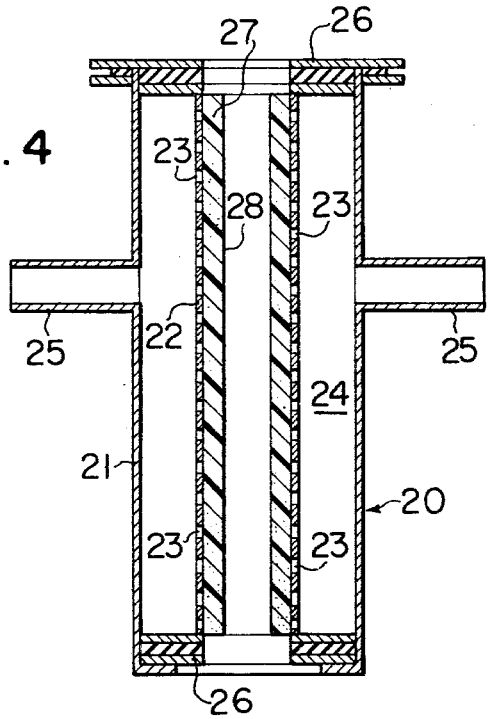
FIG. 4 is a longitudinally sectional view showing a vacuum-suction type holder which is effective to use in the method according to the present invention.

FIG. 4 shows a vacuum-suction typed holder constructed in accordance with the present invention, which is effective to hold the flexible tube-shaped film materials in an automatic fashion. This holder comprises a double-walled tube member 20 having a cylindrical outer wall 21 and a cylindrical inner perforated wall 22 spaced inward from the outer wall 21. The inner perforated wall 22 has a plurality of small opening 23 therethrough over the length and periphery thereof. The outer and inner walls 21 and 22 define an annular vacuum chamber 24 therebetween which is adapted to be connected to a source of vacuum (not shown) through at least one duct 25 mounted on the outer wall 21. The vacuum chamber 24 is sealingly closed at opposite ends by end sealing members 26 which may be mounted on any suitable fixed base. The inner perforated wall 22 is adapted to receive and hold the tube-shaped film in its open condition on the inner periphery of the inner wall 22 under the action of vacuum applying to the small openings 23 thereof through the vacuum chamber 24 from the source of vacuum via the ducts 25.

A flexible, porous layer 27 is preferably located over the inner perforated wall 22. The layer 27 may be made of open cell cellular material selected from rubber sponge, foamed polyurethane or the like. Alternatively, the layer 27 may be made of non-woven fabric of polyamide polymer, rock wool, grass wool, etc.

The flexible, porous layer 27 can be deformed radially inward when the tube-shaped film is received over the outer surface 28 of the layer 27 and the vacuum is applied to the inner periphery of the inner perforated wall 22 through the small openings 23 thereof. Therefore, the layer 27 will automatically accommodate various diameters of the tube-shaped films to be held in the range from the substantial inner diameter of the cylindrical layer 27 to the substantial inner diameter of the inner perforated wall 22.

It is to be understood that the holder shown in FIG. 4 can be used to hold various known packaging materials such as pre-cut tube-shaped films having clipped or heat-sealed ends, at a packing station.

We claim:

1. Apparatus for holding a section of flexible tube-shaped film material in an expanded condition, packaging said flexible tube and then causing the packaged tube to release under the force of gravity, said section of flexible tube shaped film material having two ends, one of which is open and the other of which is closed, said apparatus comprising:

a substantially vertically arranged double-walled tube member open-ended at both ends thereof, said tube member having a cylindrical outer wall and a cylindrical inner perforated wall spaced inwardly from said outer wall, said outer and inner walls defining an annular chamber therebetween;

end sealing members at each opposite end of said annular chamber for closing off said opposite ends of said annular chamber; and means coupling said annular chamber to a source of vacuum;

said cylindrical perforated inner wall including a cylindrical layer of flexible foamed open-cellular material which is located over the inner surface of said inner cylindrical perforated wall and against which an expanded tube-shaped film material is adapted to bear for retaining said tube-shaped film material;

whereby a tube-shaped film material is received at the upper open end of said tube member with its sealed end at the bottom, the film material is expanded under the influence of said vacuum and retained against said flexible foamed open-cellular material and filled from the top, and then released by reduction of said vacuum to drop out of the bottom of said tube member under the influence of gravity.

2. Apparatus according to claim 1, wherein said layer of flexible foamed open-cellular material is a sponge rubber material.

3. Apparatus according to claim 1, wherein said layer of flexible foamed open-cellular material is a foamed polyurethane material.

* * * * *